United States Patent [19]

Johnston et al.

[11] Patent Number: 4,486,917

[45] Date of Patent: Dec. 11, 1984

[54] DOOR CLOSER WITH A COMPRESSIBLE BRAKING SLEEVE

[75] Inventors: James R. Johnston, Sterling; Cordell E. Meiste, Morrison, both of Ill.

[73] Assignee: National Manufacturing Co., Sterling, Ill.

[21] Appl. No.: 348,608

[22] Filed: Feb. 12, 1982

[51] Int. Cl.[3] ..... E05F 3/16

[52] U.S. Cl. ..... 16/70; 16/86 R; 16/337; 92/10; 92/85 R; 92/85 B

[58] Field of Search ..... 16/70, 74, 75, 76, 80, 16/58, 337, 391, DIG. 7, DIG. 10, DIG. 17, 86 R; 188/67, 129, 271, 284, 322.17; 92/10, 11, 85 R, 85 B, 143; 267/33

[56] References Cited

U.S. PATENT DOCUMENTS

| | | | |
|---|---|---|---|
| 2,650,386 | 9/1953 | Edwards | 16/65 X |
| 2,897,534 | 8/1959 | Pickerell | 16/70 |
| 2,940,552 | 6/1960 | Freyler | 188/129 |
| 3,408,683 | 11/1968 | Zahn | 16/65 X |
| 4,357,731 | 11/1982 | Strauss | 16/70 |

FOREIGN PATENT DOCUMENTS

| | | | |
|---|---|---|---|
| 3051 | of 1913 | United Kingdom | 16/70 |
| 2024311 | 1/1980 | United Kingdom | 16/70 |

*Primary Examiner*—Fred Andrew Silverberg
*Attorney, Agent, or Firm*—Edmond T. Patnaude

[57] ABSTRACT

A door closer includes a spring-loaded piston forming part of a conventional pneumatic dashpot, which retards the speed of a door during closing, and an elastomeric sleeve which is longitudinally compressed during opening of the door to retard the speed of the door during opening and to apply substantial resistance to further opening movement as the door approaches its fully open position. Closing speed of the door is also initially retarded by the compressed sleeve.

7 Claims, 3 Drawing Figures

DOOR CLOSER WITH A COMPRESSIBLE BRAKING SLEEVE

The present invention relates in general to pneumatic door closers of the type incorporating a return spring and a pneumatic dashpot for retarding the return movement of the door to which the closer is mounted, and it relates in particular to a novel method of controlling door movement and to a new and improved pneumatic door closer which incorporates a frictional element which increasingly retards opening of the door as the door approaches the fully open position and also retards return movement of the door to provide a smooth, continuous closing movement of the door.

BACKGROUND OF THE INVENTION

The use of a spring connected between a door and its associated jamb to automatically return the door to its closed position is well known, and the use of a pneumatic or hydraulic dashpot to retard the closing speed of the door to prevent it from slamming against the door frame is also well known.

Hydraulic door closers have the added advantage of also retarding the opening speed of the door and thus inerehently preventing excessive opening of the door by wind gusts or the like. Moreover, hydraulic door closers have generally provided a smoother movement of the door during closing rather than the bouncy movement commonly associated with pneumatic door closers.

On the other hand, hydraulic door closers have an inherent leakage problem, and leakage of the hydraulic liquid not only adversely affects the operation of the door closer, but it is also messy. Moreover, hydraulic door closers are generally more expensive to manufacture than are pneumatic door closers.

SUMMARY OF THE INVENTION

Briefly, there is provided in accordance with the present invention a novel pneumatic door closer having the advantages of a hydraulic door closer i.e., resistance to opening movement and a smooth closing action, while not exhibiting the leakage problem associated with hydraulic door closers. In addition to a return compression spring and a pneumatic dashpot, the closer of the present invention includes a friction member which is compressed between the relatively movable parts of the closer to increasingly resist movement of the door in the opening and closing direction.

In a preferred embodiment of the invention the friction member is a longitudinally compressible elastomeric braking sleeve surrounding a longitudinally movable piston rod. As the door is moved toward the fully open position the sleeve is longitudinally compressed and exerts a retarding or braking force on the piston rod. This retarding force increases exponentially as the door is opened and is thus maximized when the door is fully open.

As the door moves from the fully open position toward the fully closed position the frictional retarding force gradually decreases but is sufficient to prevent rapid closing of the door until the door reaches the position where the pneumatic dashpot becomes effective to retard further movement as the door is pulled by the spring into the fully closed position. Accordingly, the door moves smoothly from the open position to the fully closed position, such movement being initially retarded by the braking element and then by the dashpot.

GENERAL DESCRIPTION OF THE DRAWINGS

The present invention will be better understood by a reading of the following detailed description taken in connection with the accompanying drawing wherein.

DETAILED DESCRIPTION OF A PREFERRED EMBODIMENT OF THE INVENTION

Figure 1:
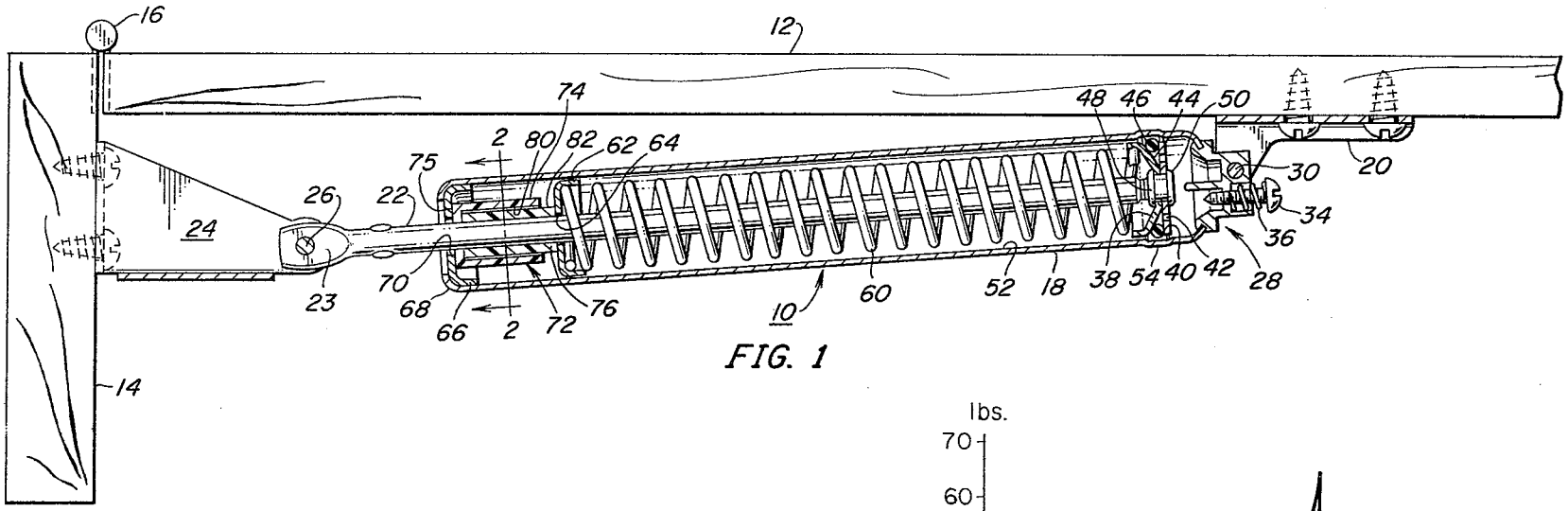
FIG. 1 is a cross-sectional view of a door closer embodying the present invention, the closer being mounted between a door and its associated door jamb.

Referring to FIG. 1, a door closer 10 is there shown to be mounted between a door 12 and a door jamb 14. The door 12 is connected to the jamb 14 by means of a plurality of conventional hinges 16. In FIG. 1 the door 12 is shown in a fully closed position and swings in a counterclockwise direction as it is opened. The door closer 10 may be seen to include a tubular cylinder or housing 18 which is pivotably attached to the door 12 by means of a bracket 20. The door closer 10 further includes a longitudinally movable piston rod 22 which is pivotably mounted to the door jamb 14 by means of a bracket 24. It will be understood by those skilled in the art that the principal longitudinal axis of the door closer 10 lies in the horizontal plane.

Considered in greater detail, the distal end of the piston rod 22 is flattened at 23 and is pivotably connected to the bracket 24 by means of a pivot pin 26 which loosely extends in a vertical direction through mutually aligned openings in the flattened portion 23 of the piston rod and through the bracket 24. Fixedly and sealably attached to the right hand end of the housing 18 (as shown in FIG. 1.) is a valve assembly 28 which is pivotablly attached to the bracket 20 by means of a pivot pin 30 which loosely extends in a vertical direction through aligned openings in the assembly 28 and in the bracket 20. In addition, the valve assembly 28 includes a conventional screw type bleed valve 34 which is adjustable to control the bleeding of air therethrough. A coil spring 36 is compressed beneath the head of the screw 34 to prevent spurious rotation of the screw 34 and spurious adjustment of the bleed rate through the valve.

Mounted to the piston rod 22 is a piston member 38 and a piston washer 40 having one or more orifices 42 provided therein. The piston member 38 is an imperforate member having a conical surface 44 facing toward the adjacent planar surface of the washer 40. A resilient O-ring 46 is disposed between the piston 38 and the washer 40. In the illustrated embodiment of the invention the piston rod 22 is provided with a flange 48 against which the piston 38 abuts, and the end 50 of the piston rod is peened over tightly against the washer 40 to lock the piston 38 and the washer 40 in mutually fixed positions on the piston rod.

The main body of the housing 18 is provided with a smooth internal cylindrical bore 52 whose diameter is greater than the external diameters of the piston member 38 and the piston washer 40. The external diameter of the O-ring 46 is, however, slightly larger than the internal diameter of the bore 52 to provide a continuous annular seal between the bore 52 and the O-ring 46. As explained more fully hereinafter, as the door is opened and the piston assembly is pulled to the left along the cylinder bore 52, air leaks between the O-ring and the piston member 38 and flows through the orifices 42 into the chamber between the piston assembly and the valve assembly 28. When, however, the piston moves in the other (closing) direction the O-ring 46 is sealably wedged against the bore 52 and the piston 38 to provide an air-tight seal between the two chambers in the housing. The housing 18 has a short section 54 having an internal diameter substantially greater than the external diameter of the seal 46. This section 54 is located at the position occupied by the piston assembly when the door closer is fully closed. It is provided to release the air from the dashpot chamber between the piston assembly and the valve assembly 28 as the door is making its final movement into the latched position whereby the full force of the spring may be utilized to operate the latch.

The door closer 10 employs a compression coil spring 60 disposed over the piston rod 22 and compressed between the piston member 38 and an annular cup member 62 which is freely slidable along the rod 22. As shown, the cup member 62 is provided with a central hole 64 which is slightly larger than the external diameter on the rod 22. The external diameter of the cup member 62 is substantially less than the internal diameter of the bore 52 so as to be freely slidable therein and permit the free passage of air past the cup member 62. A second cup member 66 is fitted into the left-hand end of the housing member 18 and the housing member 18 is deformed at 68 over the cup member 66 to prevent movement of the cup member 66 out of the left-hand end of the housing member 18. The cup member 66 is provided with a central aperture 70 which is sufficiently greater than the external diameter of the piston rod 22 so as to be freely slidable thereon.

In accordance with an important feature of the present invention there is mounted between the cups 62 and 66 a braking and energy absorbing device 72 comprising a tubular retainer member 74 and an elastomeric sleeve 76. The retainer 74 has an internal flange at one end and is apertured to slide freely along the rod 22. This flange thus provides an annular abutment against which the sleeve 76 is bottomed. The retainer 74 has a main tubular portion whose internal diameter 80 is slightly greater than the external diameter 82 of the sleeve 76. The internal diameter of the sleeve 76 is slightly greater, when the sleeve is in a relieved condition, than the external diameter of the piston rod 22. Moreover, the sleeve 76 is longer than the retainer and extends a substantial distance out of the open end of the retainer 74 with the outer end of the sleeve 76 abutting the cup member 62.

OPERATION

Preferably the door closer 10 is mounted between the door jamb and the door so that when the door is closed the spring 60 is slightly compressed to provide a preload of nineteen pounds between the piston rod 22 and the housing 18. Under these conditions the spring 60 is slightly compressed and the elastomeric sleeve 76 is very slightly compressed so that the internal surface thereof does not frictionally engage the external surface of the rod 22. As the door swings from the closed position and the piston rod is retracted from the housing 18, the spring 60 is further compressed and the elastomeric sleeve 76 is also compressed in its axial direction. The sleeve 76 is thus increasingly compressed as the door swings open whereby it more tightly grips the rod 22 to provide an increased braking action against movement of the rod through the sleeve 76 and out of the housing 18. High gripping force is exerted by the elastomeric sleeve 76 on the rod 22 through confinement of the sleeve external diameter 82 by the internal diameter 80 of the retainer 74.

Figure 3:
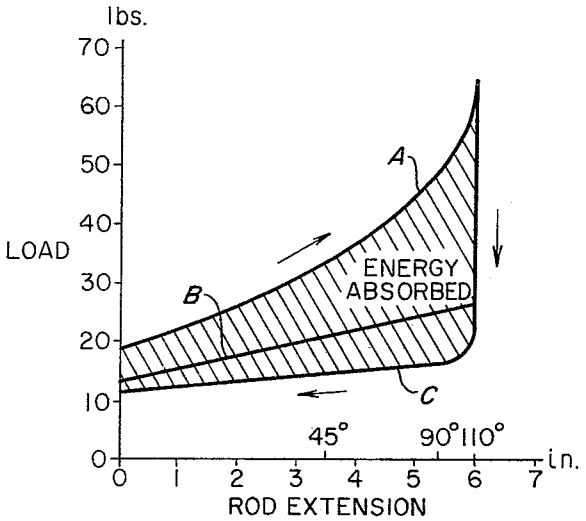
FIG. 3 is a load deflection curve useful in understanding the operation of the door closer shown in FIG. 1.
Figure 2:
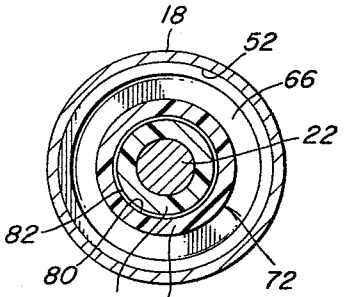
FIG. 2 is a cross-sectional view taken along the line 2—2 of FIG. 1.

With reference to FIG. 3 it may be seen that when the door is fully closed and the closure is prestressed as indicated above, the load which must be overcome to move the door is about nineteen pounds. As the door is swung open the load on the closer increases along the portion A of the load/deflection curve. When the rod is extended about two inches, the load is twenty-five pounds and at five inches the load is about fifty pounds. Normally, when the rod extension is at about five inches the door is opened to the normal extent for enabling a person to pass therethrough. When the opened door is released, the spring 60 expands to retract the piston rod 22 into the housing 18, and as the piston assembly moves to the right, the O-ring 46 is wedged between the piston 38 and the bore 52 in the housing 18 to effect an air tight seal thereby to seal the dashopt chamber in the portion of the housing 18 between the piston assembly and the valve assembly 28 from the ambient. Because of the highly compressible nature of air, the air within this dashpot chamber provides no substantial retarding force to the movement of the rod 22 back into the housing 18 at this time. However, the sleeve 76 is substantially compressed and exerts a large friction retarding force on the rod 22 as it moves through the sleeve thus providing relatively slower initial closing movement of the door. As the door approaches an approximate mid-closed position the sleeve compression or gripping force is gradually reduced, during which time the air in the dashpot has been sufficiently compressed to counteract the force of the spring 60 effectively controlling closing movement of the door. Thereafter the compressed air in the dashpot chamber slowly bleeds to the ambient through the valve assembly 28 permitting the piston assembly to move the sealing ring into the enlarged portion 54 of the housing thereof. At this time the seal to the dashpot chamber is completely broken wherefor the dashpot provides no further resistance to retraction of the piston rod and the final closing movement of the door.

In FIG. 3, the straight line marked B is the load deflection characteristic of the spring 60 alone, i.e., if the sleeve 76 were omitted and the bleed valve were left fully open.

It may be seen from an examination of FIG. 3, that the force required to open a door utilizing the closer of the present invention increases exponentially because of the action of the braking sleeve 76. Indeed, it will be seen that the force required to move the door between a position where the rod extension is five inches and the position where it is six inches is approximately twenty-five pounds. This large braking force is sufficient in most cases to prevent gusts of wind and the like from damaging the door assembly, the door closer or other parts.

Also, an examination of FIG. 3 will indicate that the portion C of the load/deflection curve indicates the force required to close the door, i.e., to push the rod 22 and the piston assembly into the housing 18 after it has been retracted therefrom. It will be seen that this portion of the curve is relatively linear wherefor the door moves from the open to the closed position in a smooth continuous manner. In the absence of the braking sleeve 76 when the fully opened door is released the initial retarding force is extremely low and increases as the air becomes more fully compressed within the dashpot chamber to the right of the piston assembly. As a result, when the fully opened door is released, the door quickly moves toward the closed position until the air is sufficiently compressed within the dashpot chamber to stop the door. The door then bounces back a short distance in the opening direction and in a series of bounces moves into the fully closed position.

It may thus be seen that the door closer of the present invention provides the advantages of ease of manufacture, maintenance-free operation and reliability normally associated with pneumatic door closers while additionally providing resistance to excessive high speed opening and a smooth, non-bouncy closing of the door.

While the present invention has been described in connection with a particular embodiment thereof, it will be understood by those skilled in the art that many changes and modifications may be made without departing from the true spirit and scope of the present invention. Therefore, it is intended by the appended claims to cover all such changes and modifications which come within the true spirit and scope of this invention.

What is claimed:

1. A door closer adapted to be mounted between a door member and a door frame member, comprising in combination housing means adapted to be mounted to one of said door or door frame members and having a chamber therein, piston means mounted for reciprocable movement between a first position and a second position in said chamber, abutment means affixed to said housing, elastomeric brake sleeve means mounted between said piston maans and said abutment, means, spring means disposed between said piston means and one end of said brake sleeve means for longitudinally compressing said brake sleeve means against said abutment means as said piston means moves toward said second position and for biasing said piston means toward said first position, rod means affixed to said piston means and extending through said brake sleeve means, said rod means being adapted to be mounted to the other one of said members, said rod means extending loosely through said brake sleeve means when said brake sleeve means is in a longitudinally unstressed condition and being frictionally engaged by said sleeve means when said brake sleeve means is longitudinally compressed, and rigid sleeve means enclosing at least a portion of said brake sleeve means for restricting the radial expansion of said sleeve means when said sleeve means is longitudinally compressed between said spring means and said abutment means.

2. A door closer according to claim 1 wherein said rigid sleeve means is positioned against said abutment means and encloses one end portion of said brake sleeve means.

3. A door closer according to claim 2 wherein sad brake sleeve means extends from said rigid sleeve means toward said spring means.

4. A door closer according to claim 3, wherein said brake sleeve means is tightly fitted in said rigid sleeve means.

5. A door closer according to claim 1 wherein said chamber is a cylindrical bore having a longitudinal axis, and said rod means lies along the longitudinal axis of said bore.

6. A door closer according to claim 5 wherein said housing includes a tubular member, said abutment means includes an annular member affixed to one end of said tubular member, and said rod means loosely extends through said annular member.

7. A door closer according to claim 6 comprising a second end member affixed to the other end of said tubular member, and adjustable orifice means in said second end member.

* * * * *